United States Patent [19]

Tsuji et al.

[11] Patent Number: 4,653,987

[45] Date of Patent: Mar. 31, 1987

[54] FINGER PERISTALTIC INFUSION PUMP

[76] Inventors: Tsuyoshi Tsuji, 330 No. 39-2, 1-chome, Toro-cho, Omiya-shi, Saitama-ken; Naosumi Nagahori, 336 No. 1-25, 1-chome, Daitakubo, Urawa-shi, Saitama-ken, both of Japan

[21] Appl. No.: 774,572

[22] Filed: Sep. 10, 1985

[30] Foreign Application Priority Data

Sep. 12, 1984 [JP] Japan ..... 59-139202

[51] Int. Cl.[4] ..... F04B 43/12; A61M 1/00

[52] U.S. Cl. ..... 417/360; 417/412; 417/474; 128/DIG. 12; 222/214; 604/153

[58] Field of Search ..... 417/474, 475, 360, 412; 604/67, 151–153; 128/DIG. 12; 222/214

[56] References Cited

U.S. PATENT DOCUMENTS 2,412,397 12/1946 Harper ..... 417/474
3,778,195 12/1973 Bamberg ..... 417/474
3,816,033 6/1974 Fried et al. ..... 417/475 X
4,302,164 11/1981 Manella ..... 417/474
4,479,797 10/1984 Kobayashi et al. ..... 604/153
4,482,347 11/1984 Borsanyi ..... 417/474
4,547,136 10/1985 Rothstein ..... 417/475

*Primary Examiner*—John J. Vrablik
*Attorney, Agent, or Firm*—Fleit, Jacobson, Cohn & Price

[57] ABSTRACT

In an infusion pump or especially a peristaltic infusion pump of the type in which a drug liquid is forced to flow through an infusion tube by peristalsis, the pump mechanism can be readily pulled out of the main body. More specifically, the pump mechanism can be detachably fitted into and held at a predetermined position in a pump mechanism housing recess defined in an infusion pump casing and the pumping mechanism is then drivingly coupled through a suitable power transmission mechanism with a driving means disposed within the casing. And the pump mechanism is separated from the interior of the casing by means of the pump mechanism housing recess.

5 Claims, 7 Drawing Figures

FINGER PERISTALTIC INFUSION PUMP

BACKGROUND OF THE INVENTION

The present invention relates to an improvement of a finger peristaltic infusion pump to forcibly flow an infusion mixture such as a drug liquid through a tube in one direction thereof.

There have been devised and demonstrated various types of finger peristaltic infusion pumps of the type in which a liquid such as blood or a drug liquid is pumped through an infusion tube in one direction thereof by peristalsis of the infusion tube. However, in these pumps, a pump mechanism for squeezing or causing peristalsis of an infusion tube is formed integral with the main body of the infusion pump.

When the infusion pumps of the type described above are used in practice, the pump main body and the pump mechanism are frequently immersed with a drug liquid or an infusion mixture leaked from a container disposed above the infusion pump. Especially a drug liquid containing as a major portion glucose tends to increase its concentration due to the evaporation of water, thus resulting in the increase in viscosity. As a result, the operation of the infusion pump is adversely affected. Furthermore, when the infusion pump is not operating, the water is completely evaporated so that glucose remains in the pump, thus preventing the movement or rotation of moving or rotating parts of the infusion pump.

As a result, the object of the infusion pump for pumping an infusion mixture cannot be attained. Whereby there arises the problem that an accident for breaking a power transmission mechanism occurs due to the driving force of a motor.

Furthermore, it is difficult to wash and clean off the leaked infusion mixture so that it is difficult to maintain the infusion pump in a sanitary state.

The conventional pumps cause the wear of a pump mechanism when they have been used for a long time so that they cannot function properly. As a result, the whole infusion pump must be replaced or the pump mechanism must be disassembled and replaced. Therefore, when the time required for maintaining and reparing the broken infusion pumps is taken into consideration, a relatively large number of infusion pumps must be always kept, which is very uneconomical.

SUMMARY OF THE INVENTION

. The present invention was made in order to overcome the above and other problems encountered in the conventional infusion pumps and therefore has for its object to provide an infusion pump which can eliminate the adverse effects of the leakage of an infusion mixture on a pump mechanism and can avoid the sticking of the moving or rotating parts thereof; which can be maintained always in a sanitary state and whose maintenance and repair is much facilitated.

Therefore, according to the present invention, the following effects, features and advantages can be attained:

a. Only the pump mechanism can be readily pulled out of the pump main body and washed and sterilized so that the smooth pump operation is not adversely affected by the leakage of an infusion mixture and the sticking of moving or rotating parts thereof can be avoided.

b. When the pumping mechanism is inserted into the pump mechanism housing or recess, the stepped portion of the pump mechanism is adapted to engage with the front edge of the pump mechanism housing or recess and the side walls of the pump mechanism are made to engage with the guide projections so that the pump mechanism can be correctly located at a predetermined position in the pump mechanism housing recess and can be drivingly coupled with a driving means on the side of the main body.

c. Flashing portions are provided at the position where the inserted pump mechanism is drivingly coupled with the driving means on the side of the main body and furthermore an incline is provided for the pump casing so that the infusion mixture which leaked into the pump mechanism housing recess can be prevented from entering the pump main body and can be readily discharged out of the infusion pump.

d. When the pump mechanism breaks, the infusion pump can be repaired immediately by merely replacing the broken pump mechanism with a new one. As a result, a minimum number of infusion pumps may be kept in use which is very economical.

The above and other objects, effects, features and advantages will become more apparent from the following description of the prefered embodiments thereof taken in conjunction with the accompanying drawings.

BRIEF DESCRIPTION OF THE DRAWINGS

Same reference numerals are used to designate similar parts throughout the figures.

DESCRIPTION OF THE PREFERRED EMBODIMENTS

Figure 1:
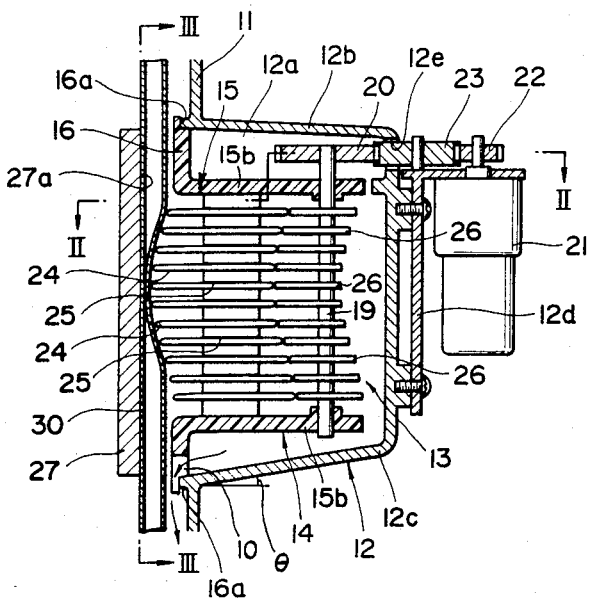
FIG. 1 is a longitudinal sectional view of a first embodiment of a finger peristaltic infusion pump in accordance with the present invention.
Figure 2:
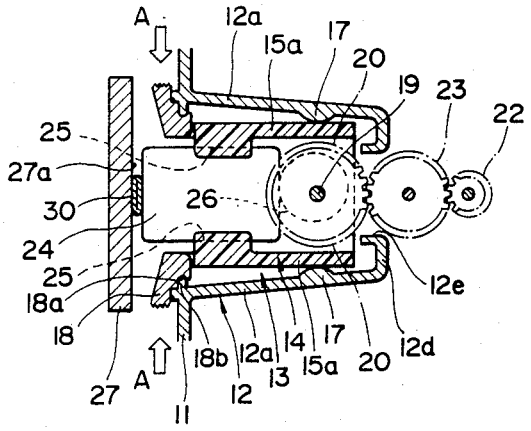
FIG. 2 is a sectional view taken along the line II—II of FIG. 1.
Figure 3:
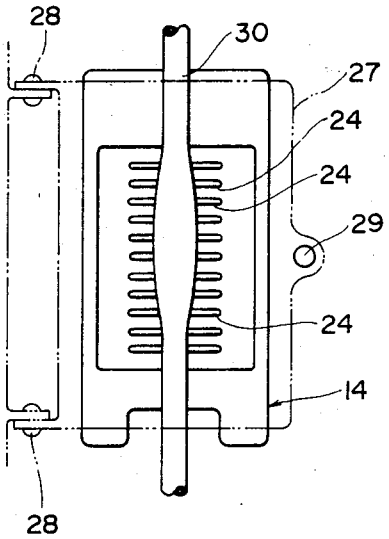
FIG. 3 is a view looking in the direction indicated by the arrows III—III.
Figure 4:
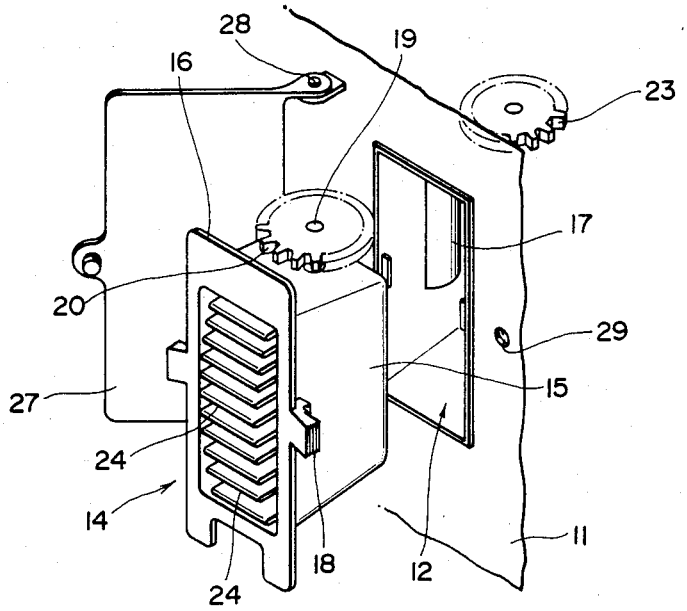
FIG. 4 is a perspective view illustrating a pump mechanism pulled out of the main body of the infusion pump.

Referring to the accompanying drawings, the preferred embodiments of the present invention will be described.

FIG. 1–4 show a first embodiment of the present invention and reference numeral 11 designates a box-shaped casing of an infusion pump. The side walls **12*a*, the upper and lower walls 12*b* and 12*c* and the inner wall 12*d* define a housing 12 for housing therein a pump mechanism which is separated from the interior 13 of the infusion pump main body. The leading or front end portion of the bottom wall 12*c*** is inclined at an incline.

Reference numeral 14 designates a finger peristaltic infusion pump mechanism which is detachably disposed in a recess 13 for housing the pump mechanism. The stepped portion **16*a* of the front flange 16 of the frame 15 of the pump mechanism 14 engages with the front edge of the pump mechanism housing 12 and the side walls 15***a* of the mechanism 14 are placed into contact with guide projections 17 of the side walls 12*a*, whereby the frame 15 of the pump mechanism 14 is fitted into the pump mechanism housing 12 and located at a predetermined position.

The pump mechanism 14 has such an engaging mechanism that an engaging groove 18*a* at the engaging projection 18 at the leading end of the side wall 15*a* of the frame 15 (which is made of a plastic) engages elastically (due to the elasticity of the frame 15) with the projection 18*b* extended from the leading end of the side wall 12*a* and when the engaging projection 18 is pushed in the direction indicated by the arrow A, the engaging projection 18*b* is disengaged from the engaging groove 18*a*.

A driven gear 20 securely attached to the upper end of a cam shaft 19 extended rotatably between the upper and lower plates 15*b* of the frame 15 is made into mesh with a driving gear 23 which in turn is coupled drivingly through a suitable power transmission means 22 to a drive motor 21 in communication with the interior of housing recess 13 of the main body through an opening 12*e* defined by the flashing portions of the inner walls 12*d* when the frame 15 is fitted into the pump mechanism housing 12. A plurality of pressure plates 24 are disposed in the vertical direction between the side plates 15*a* and are spaced apart from each other by a suitable distance in such a way that they can restrict the free deformation or expansion of a fusion tube 30. These pressure plates 24 are slidably fitted into the sliding grooves 25 of the side plates 15*a* in such a way that they are slidable forwardly or backwardly. The rear ends of the pressure plates 24 are placed into contact with the cam surfaces, respectively, of disk-shaped eccentric cams 26 carried by the cam shaft 19 in such a way that their angular positions are varied sequentially by a predetermined angle. It should be noted that at least one of the pressure plates 24 is brought to and maintained at the foremost position. A cover plate 27 is attached with hinges 28 to the front surface of the pump mechanism housing 12 in such a manner that when the pump mechanism 14 is fitted into the housing 12, the cover plate 27 closes the pump mechanism housing 12. In order to keep the cover plate 27 in its closed position, the cover plate 27 is provided with a locking mechanism 29 such as a screw. A pressure receiving surface 27*a* attached to the inner surface of the cover plate 27 is spaced apart from the leading or front ends of the pressure plates 24 by a such a distance that when one of the pressure plates 24 is extended to its foremost position by means of its corresponding disk-shaped eccentric cam 26, it presses the infusion tube 30 so as to completely close the tube 30.

Figure 5:
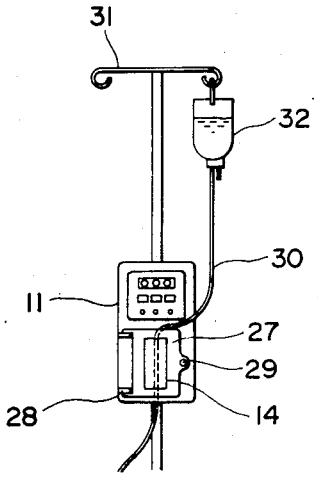
FIG. 5 is a front view showing how the infusion pump is used.

FIG. 5 shows the fusion pump with the above-described construction. The casing 11 is securely attached to, for instance, the column of a stand 31 and the infusion tube 30 whose upper end is connected to the outlet of a container containing an infusion mixture 32 is extended between the pressure-receiving surface 27*a* of the cover plate 27 and the pressure plates 24 of the pump mechanism 14.

When the motor 21 is energized, its rotation is transmitted through the power transmission means 22, the driving gear 23 and the driven gear 20 to the cam shaft 19 and consequently the disk-shaped eccentric cams 26 are rotated. As a result, the peristaltic movement of the pressure plates 24 which are disposed in opposed relationship with the infusion tube 30 in the axial direction thereof is started so that the infusion tube 30 is sequentially pressed by the pressure plates 24 from the inlet toward the outlet of the infusion tube 30. As a result, the infusion tube 30 is deformed like a wave so that the infusion mixture is forced to flow through the tube 30.

In the infusion pump of the type described above, a portion of the interior of the casing 11 defines a pump mechanism housing recess 13 into which the pump mechanism 14 is detachably fitted.

The infusion pump of the present invention has the feature that when the projection 18 is pushed in the direction indicated by the arrow A, it is disengaged from the engaging groove 18*a* so that only the pump mechanism 14 can be removed, washed and sterilized. In addition, the troubles that the operation of the infusion pump is adversely affected and the moving parts are prevented from moving or rotating due to the leakage of the infusion mixture can be avoided.

According to the first embodiment, the pump mechanism 14 is adapted to engage with the stepped portion 16*a* of the pump mechanism housing 12 and the side walls 15*a* are adapted to engage with the guide projections 17 so that the pump mechanism 14 can be fitted at a predetermined position. The driven gear 20 is made into mesh with the driving gear 23 of a driving system on the side of the main body so that the pump mechanism 14 is drivingly coupled with the motor 21. In addition, the flashing portions 12*e* and the incline $\theta$ are provided with an outlet opening 10 so that the infusion mixture or the like which has leaked into the pump mechanism housing recess 13 can be prevented from further flowing into the main body.

Figure 7:
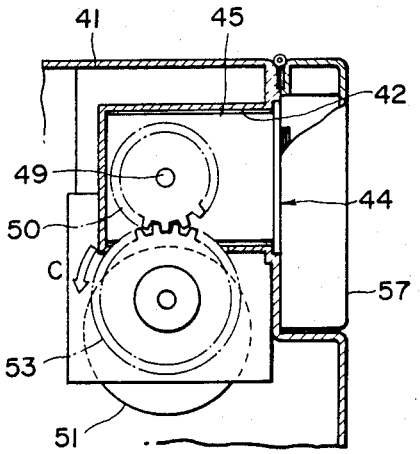
FIG. 7 is a partial top view showing the pump mechanism inserted into the pump mechanism housing recess.
Figure 6:
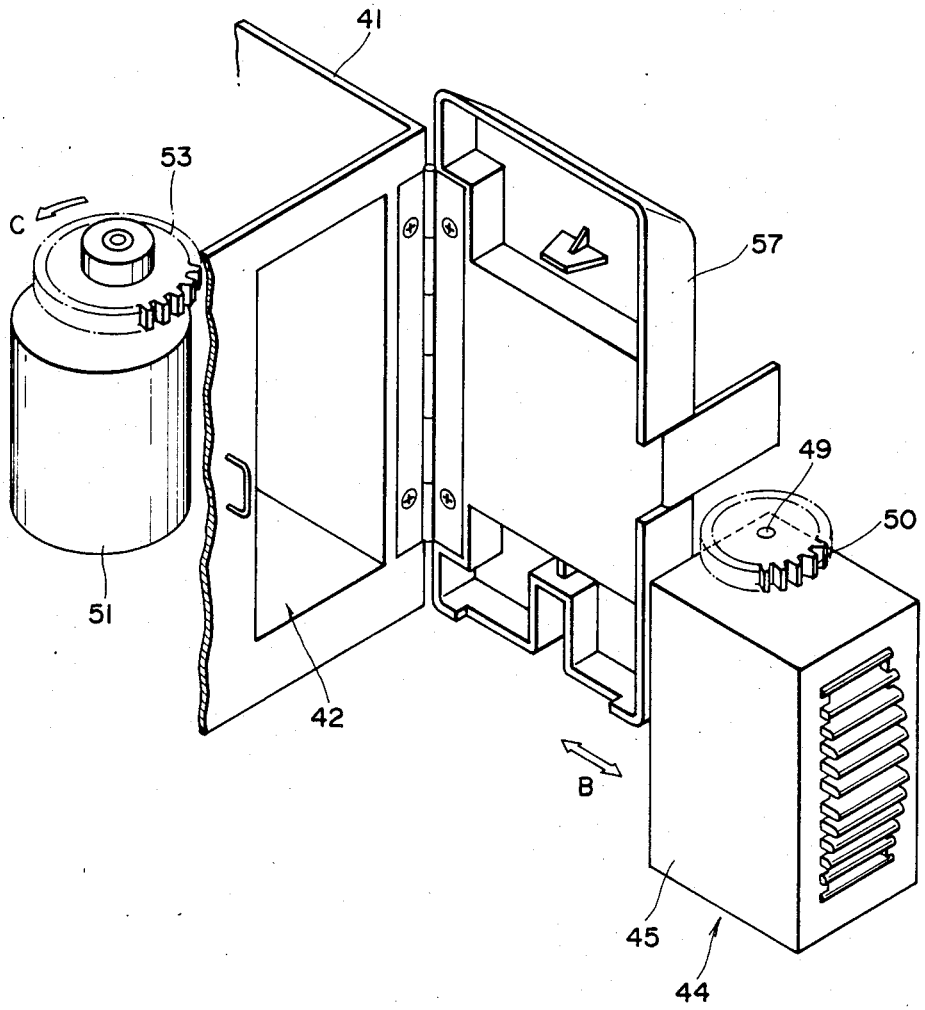
FIG. 6 is a perspective view of a second embodiment of a finger perstaltic infusion pump in accordance with the present invention with the pump mechanism being pulled out of the main body.

FIGS. 6 and 7 show a second embodiment of the present invention which is substantially similar in construction described above with reference to FIGS. 1–4 except for a pump mechanism housing recess 42 and a pump mechanism 44. Therefore in the second embodiment only the recess 42 and the pump mechanism 44 will be described.

The casing 45 of the pump mechanism 44 and a driven gear 50 carried by a cam shaft 49 extened upwardly beyond the top surface of the casing 45 can be detachably inserted through the front aperture into the pump mechanism housing recess 42. When the pump mechanism 44 is fitted into the pump mechanism housing recess, a cover plate 57 is closed to cover the pump mechanism 44 inserted into the recess 42. When the pump mechanism 44 is fitted into the pump mechanism housing recess 42 in the direction indicated by the double pointed arrow B, the driven gear 50 of the pump mechanism 44 is meshed with a driving gear 53 of a motor 51 mounted at a suitable position in a box-shaped casing 41, whereby upon rotation of the motor 51 in the direction indicated by the arrow C, the cam shaft 49 is rotated. In this case, the driving load is exerted to the casing 45 in the direction in which the pump mechanism 44 is inserted into the recess 42.

In the second embodiment, unlike the first embodiment, no locking or retaining means for securely holding the pump mechanism 44 in the pump mechanism housing recess 42 is provided. However, upon rotation of the motor 51, gear 53 drivingly engages gear 50 as shown in FIG. 7 and the pump mechanism 44 is supported by the pump mechanism housing recess 42. Upon de-energization of the motor 51, the force exerted by gear 53 meshing with gear 50 when the motor 51 is energized is released, and the resistance against pulling the pump mechanism 44 is eliminated so that the pump mechanism 44 can be easily pulled out of the pump mechanism housing recess 42. As a result, the same effects as the first embodiment can be attained.

As described above, according to the present invention, the pump mechanism can be detachably fitted into the pump mechanism housing recess so that when the pump mechanism is pulled out of the recess, it can be washed with water and sterlized. As a result, even when the infusion mixture or the like leaks into the pump mechanism, the operation of the pump mechanism will not be adversely affected and the moving parts can be prevented from sticking to each other. Thus, the infusion pump in accordance with the present invention can be always maintained in a sanitary state.

When the pump mechanism is worn or broken due to aging, only the pump mechanism may be replaced. Therefore, the maintenance of the infusion pump in accordance with the present invention is very simple.

As described above, according to the present invention, the infusion pipe is extended between the pressure-receiving plate or surface and the pump mechanism so that the pump mechanism can be detachably disposed regardless of the direction of the infusion tube or regardless whether the fusion tube is extened vertically or horizontally.

So far the pump mechanism has been described as being inserted into the pump mechanism housing recess through the opening formed through the front wall thereof, but it is to be understood that the infusion pump can be so designed and constructed that the pump mechanism may be detachably and slidably inserted through the opening at the bottom of the housing. Therefore various modifications can be effected without departing the true spirit of the present invention.

What is claimed is:

1. A peristaltic infusion pump for use with an infusion tubing, comprising:

a pump casing having a recess on one side, a prime mover mounted on the casing, a cover plate mounted onto the casing and having an open and closed position, a pump mechanism comprising a body, a plurality of pressure plates mounted on the body, each plate having a front end for contact with an infusion tube, driving means mounted on the body of the pump mechanism for successively actuating the plurality of pressure plates, the pumping mechanism being received within the recess defined by the pump casing, means detachably connecting the pump mechanism to the pump casing, said cover plate in the open position allowing the pump mechanism to be detachably inserted and removed from the recess of the casing, said cover plate in the closed position locating the tubing relative to the plurality of pressure plates and coacting with the plurality of pressure plates to serve as a pressure surface therefor, and a transmission means drivingly interconnecting the prime mover and the driving means of the pump mechanism.

2. The peristaltic infusion pump of claim 1 wherein said cover plate is mounted on said pump casing by means of a hinge, and further contains a locking means to maintain said cover plate in the closed position.

3. The peristaltic infusion pump of claim 1 wherein an opening is provided in the bottom part of said pump mechanism which communicates the recess of the pump casing with the exterior, and wherein the bottom wall of the pump casing is inclined in the direction of the opening, whereby liquid leaking into the recess of the pump casing is discharged through the opening.

4. The peristaltic infusion pump of claim 1 wherein the transmission means drivingly interconnecting the prime mover and the driving means of the pump mechanism includes a driven gear connected to drive the driving means, a driving gear driven by said prime mover, said driving gear meshing with said driven gear when said pump mechanism is inserted into the recess of the pump casing, whereby upon rotation of the prime mover the pressure plates are actuated.

5. The peristaltic infusion pump of claim 4 wherein the pump casing has an opening, said transmission means passed therethrough, so that when the pump mechanism is inserted into the recess of the pump casing, said driving gear and said driven gear mesh.

* * * * *